US005156282A

United States Patent [19]

Thorsen

[11] Patent Number: 5,156,282

[45] Date of Patent: Oct. 20, 1992

[54] APPARATUS FOR CORRECTING SKEW OF A TRAVELING CRANE

[76] Inventor: George E. Thorsen, 2344 N. 119th St., Wauwatosa, Wis. 53226

[21] Appl. No.: 806,682

[22] Filed: Dec. 13, 1991

[51] Int. Cl.[5] ..... B61F 13/00

[52] U.S. Cl. ..... 212/147; 105/163.2

[58] Field of Search ..... 212/147, 205; 105/163.1, 163.2, 171; 104/98, 126

[56] References Cited

U.S. PATENT DOCUMENTS

| | | | |
|---|---|---|---|
| 1,858,929 | 5/1932 | Harry | 105/163.2 |
| 2,601,831 | 7/1952 | Caillard | 105/163.2 |
| 3,095,829 | 7/1963 | Dehn | 105/163.2 |
| 3,166,023 | 1/1965 | Lynd | 105/163.2 |
| 4,890,750 | 1/1990 | Stern | 105/163.2 |
| 5,056,671 | 10/1991 | Thorsen | 212/147 |
| 5,080,021 | 1/1992 | Thorsen | 105/163.2 |

FOREIGN PATENT DOCUMENTS

| | | | |
|---|---|---|---|
| 745912 | 12/1943 | Fed. Rep. of Germany | 105/163.2 |
| 575727 | 4/1958 | Italy | 105/163.2 |
| 334768 | 1/1959 | Switzerland | 105/163.2 |

*Primary Examiner*—Jesus D. Sotelo
*Assistant Examiner*—Stephen P. Avila
*Attorney, Agent, or Firm*—Richard C. Ruppin

[57] ABSTRACT

A skew correcting apparatus for a crane supported on spaced apart generally parallel rails by a plurality of wheels including a drive wheel traveling on each of the parallel rails. The drive wheels traveling on the spaced apart rails are driven such that they rotate at the same speed. One of the drive wheels has an axially extending single diameter cylindrical surface engaging the top side of the rail head and a radially extending circumferential flange facing the inner side of the rail head. In one of the skewed positions of the crane, one of the wheels lags the other of the wheels and is subject to high levels of skew force such that the flange of the lagging wheel and the inner side of the rail head it faces engage each other. Each one of the wheels also includes a flange juncture surface joining the cylindrical surface of the flange of each wheel. The flange juncture surface faces the shoulder surface of the rail head and includes a flange cross-sectional curvature having a flange radius greater than the shoulder radius of the faced rail head. In the lagging one of the wheels, in response to small levels of skew force less than the levels of skew force that cause the flange of the lagging wheel and the inner side of the rail head to engage, the flange juncture surface moves into engagement with the facing shoulder surface to increase the diameter of the lagging one of the wheels in engagement with the shoulder surface.

12 Claims, 3 Drawing Sheets

APPARATUS FOR CORRECTING SKEW OF A TRAVELING CRANE

FIELD OF THE INVENTION

This invention relates to overhead traveling cranes which operate on spaced apart rails and, in particular, to the correction of skewing of such cranes on their rails.

BACKGROUND OF THE INVENTION

Overhead cranes which travel on their wheels along spaced apart generally parallel rails are subject to the continuous problem of the skewing of the crane on the rails. The forces causing skewing are due to rail displacement caused by rail support changes, rail deterioration resulting from improper adjustment of acceleration and deceleration forces of drive motors and brakes, and variations in traction due to rail contamination from moisture vapor and airborne particles. The skewing itself exacerbates the problem since it produces stresses on the rail structure which contribute further to the displacement of the rails. Moreover, the skewing causes severe stressing and wear of the crane wheels. The end result of rail displacement and deterioration and consequent increased skewing is a short wear life of the rails requiring their relatively frequent replacement and very frequent replacement of the wheels.

Various prior art solutions to the skewing problem have been developed. These include controls in which a sensing device is used for detecting skew and adjusting the drive motors of the crane to correct the skew. For example, in a crane having driving wheels at opposite bridge ends of the crane independently driven, slowing the motor of the drive wheel at the leading skewed bridge end will correct the skew. Another approach, upon sensing skew of the bridge, is to either apply a friction drag to the leading skewed end of the bridge or activate a wheel brake on the leading drive wheel of the skewed bridge.

The problem with the prior art anti-skewing devices utilizing wheel rotational speed principles is not that they rely on either a separate drive for the drive wheels on the opposite ends of the crane bridge or on variable speed drives so that one wheel can travel at a different speed than the other. With these types of drive systems, it is possible to slow the lead wheel in a suitable manner so that the crane returns to a parallel running position relative to the rails on which it travels.

A further solution, disclosed in U.S. Pat. No. 3,095,829 to Dehn, in a crane having drive wheels driven and controlled independently, is to decrease the clearance between the rail and the outside flange of each of the drive wheels. Consequently, the outside flange of the leading drive wheel, when the crane moves to a skewed position, will contact the outer side of the rail on which it rides and cause that wheel as well as its drive system to slow down due to the resulting friction and thereby correct the skew. In the Dehn approach, however, only independently driven wheels which can slow relative to each can be used.

In U.S. patent application Ser. No. 07/503,348, filed Apr. 2, 1990 now U.S. Pat. No. 5,080,021 issued Jan. 14, 1992 and assigned to the assignee of the present application, a skew correction arrangement is disclosed in which the crane wheels are driven at the same speed and the clearance distance between each crane drive wheel and the rail is decreased. This results in the flange of a lagging skewed drive wheel riding up on to a rail shoulder and rotating at a larger diameter so that the linear speed of the lagging wheel increases to correct the skew. The instant invention is an improvement of this skew correction approach.

SUMMARY OF THE INVENTION

It is a general object of the invention to provide a method and apparatus for correcting skew of a traveling crane operating on spaced apart rails in which the drive wheels that rotate on the spaced apart rails always rotate at the same speed.

The invention is accomplished by providing a crane supported on spaced apart generally parallel rails by a plurality of wheels including a drive wheel traveling on each of the parallel rails. The drive wheels traveling on the spaced apart rails are driven such that they rotate at the same speed. One of the drive wheels has an axially extending single diameter cylindrical surface engaging the top side of the rail head and a radially extending circumferential flange facing the inner side of the rail head. In one of the skewed positions of the crane, one of the wheels lags the other of the wheels and is subject to high levels of skew force such that the flange of the lagging wheel and the inner side of the rail head it faces engage each other. Each one of the wheels also includes flange juncture means joining the cylindrical surface of the flange of each wheel. The flange juncture means faces the shoulder surface of the rail head and includes a flange cross-sectional curvature having a flange radius greater than the shoulder radius of the faced rail head. In the lagging one of the wheels, in response to small levels of skew force less than the levels of skew force that cause the flange of the lagging wheel and the inner side of the rail head to engage, the flange juncture means moves into engagement with the facing shoulder surface to increase the diameter of the lagging one of the wheels in engagement with the shoulder surface and increase the linear speed of the lagging wheel to correct skew and minimize the engagement of the flange of the lagging wheel and the inner side of the rail head. The flange juncture means has a diameter increasing along the curvature defined by the flange radius in a direction away from the cylindrical surface. Thus, the flange juncture means has a circumferential flange surface which has a larger diameter than the diameter of the cylindrical surface.

The flange means also has a cross-sectional curved portion having a curvature in a radial outward direction away from the inner side of the rail head which the flange faces for avoiding engagement between the flange means and the inner side of the facing rail head during small skew force correcting engagement between the flange juncture means and the rail head shoulder surface.

BRIEF DESCRIPTION OF THE DRAWINGS

Further objects and advantages of the invention will appear when taken in conjunction with the accompanying drawings, in which.

DETAILED DESCRIPTION OF THE INVENTION

Figure 1:
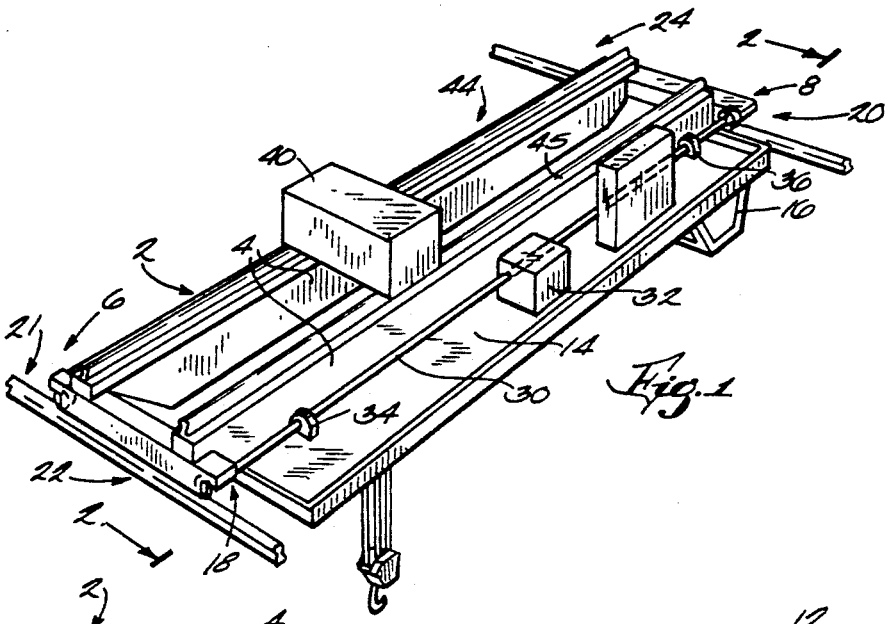
FIG. 1 is a perspective view of a traveling crane incorporating the apparatus of the invention.
Figure 2:
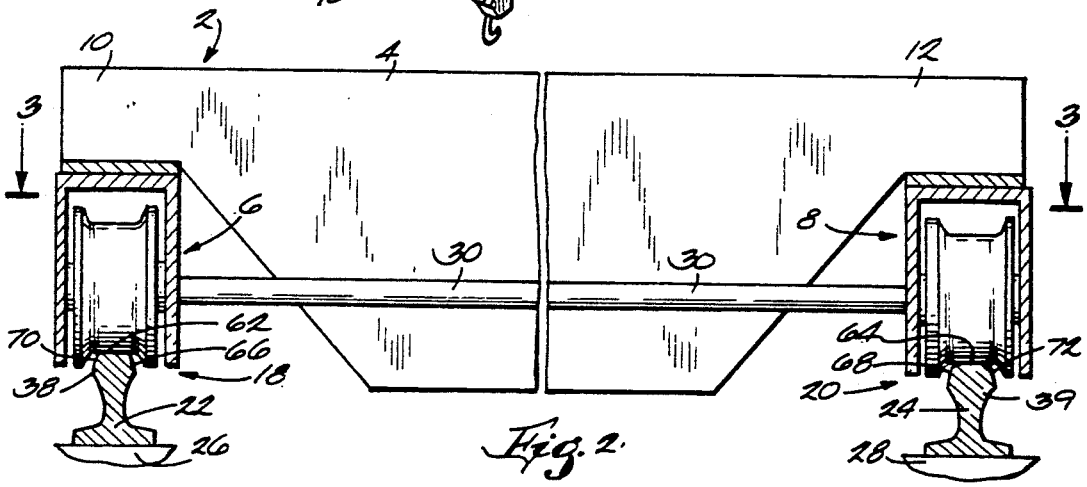
FIG. 2 is a front elevation view, in cross-section taken along lines 2—2 of FIG. 2 and partially broken away, of the crane illustrated in FIG. 1.

Referring generally to FIGS. 1 and 2, an overhead traveling crane is shown as having a frame 2 including a pair of bridge cross-members 4, trucks 6 and 8 respectively at opposite ends 10 and 12 of the cross-members 4, and a footwalk 14. An operator's cab 16 is suspended from the frame 2. Drive wheels 18 and 20 are respectively rotatably mounted on the trucks 6 and 8 in engagement with the rails 22 and 24 so that the latter support the crane. Additional nondriven wheels 21 and 23 are respectively rotatably mounted on the trucks 6 and 8 in engagement with the rails 22 and 24 for support of the crane. The rails are mounted on beams 26 and 28 or other suitable foundation means. The rotatable engagement of the drive and nondriven wheels with the rails 22 and 24 permits travel of the crane along the rails.

A shaft 30 driven by motor drive means 32 and supported by the drive means 32 and journal boxes 34 and 36 interconnects the two drive wheels 18 and 20 so that they have the same rotational speed as they travel along the rails 22 and 24. A hoist 40 having a load hook 42 is supported for travel on tracks 44 and 45 which are mounted on the cross-member 4 of the crane. The hoist 40 also includes motors (not shown) for moving the hoist 40 along the tracks 44 and 45 and for raising and lowering the load hook 42. The crane may be operated by well-known controls, not shown, which control the operation of the motor drive means 32, the movement of the hoist 40 on the tracks 44 and 45 and the raising and lowering of the load hook 42.

Figure 4:
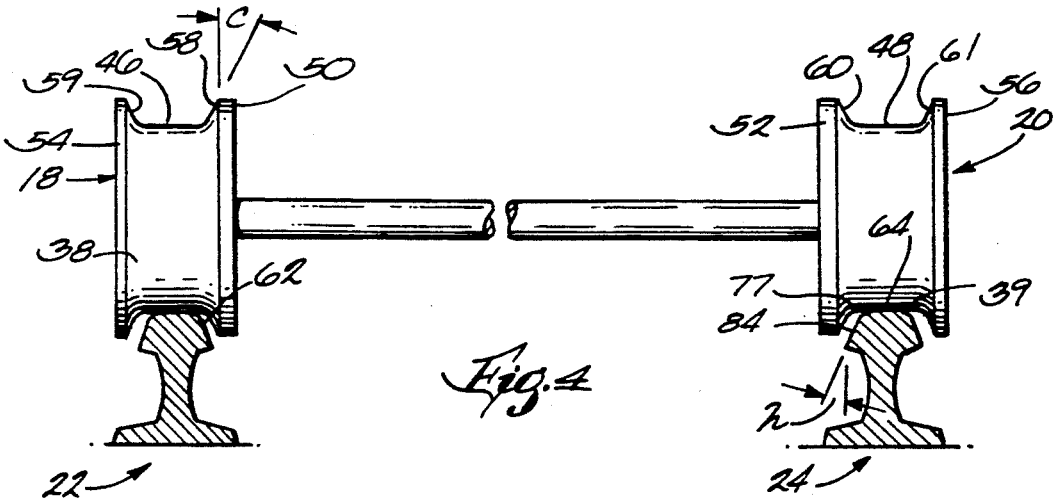
FIG. 4 is a front elevation view showing only the drive wheels of the crane of FIGS. 1-3 on the rails in a parallel, non-skewed traveling position.
Figure 4A:
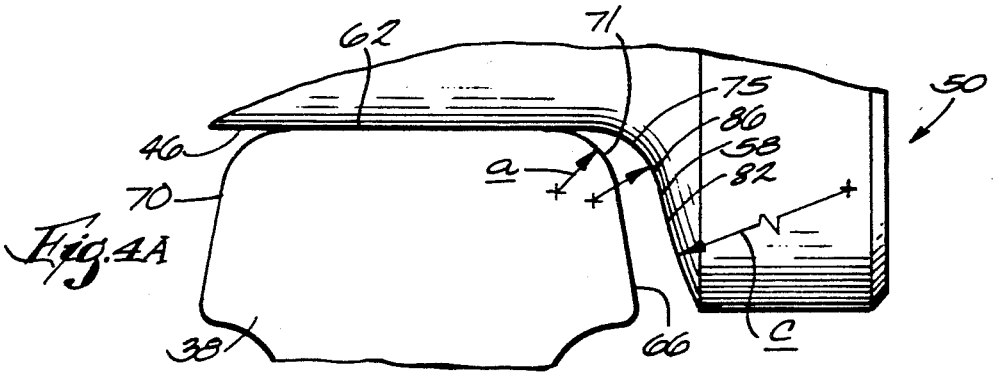
FIG. 4A is an enlarged front elevation view, broken away and illustrating one of the wheels and a rail shown in FIG. 4.

With reference to FIGS. 2 and 4, the drive wheels 18 and 20 are respectively shown engaging rails 22 and 24 in a position in which the crane is traveling in a position parallel to the rails 22 and 24. The wheels 18 and 20 respectively include cylindrical surfaces 46 and 48 each having a single diameter along its axial width. The wheels 18 and 20 also respectively include first inside flanges 50 and 52 and second outside flanges 54 and 56, each having larger diameters than the diameters of the cylindrical surfaces. The rails 22 and 24 respectively include heads 38 and 39 having top sides 62 and 64, inner sides 66 and 68, and outer sides 70 and 72. The top sides may have a flat surface but more typically have a crown surface as shown in the cross-section in FIGS. 2 and 4. The inner sides 66 and 68 are positioned at an angle, shown in FIG. 4, typically of a value of zero to fifteen degrees relative to the vertical, in a direction downward and away from the rail head or radially outward toward a facing flange. Also each rail head 38 and 39 respectively includes rail head shoulder surfaces 71 and 73 respectively joining and positioned between the top side 62 and inner side 66 and joining and positioned between the top side 64 and inner side 68. Each rail head shoulder surface 71 and 73 has a cross-sectional curvature with a radius a as shown in FIG. 4A.

The inside flanges 50 and 52 of the wheels respectively include radially extending circumferential inside surfaces 5 and 60 which respectively face inner side 66 of rail head 38 and inner side 68 of rail head 39. The outside flanges 54 and 56 of the wheels 18 and 20 respectively include circumferential inside surfaces 59 and 61 which respectively face outer side 70 of rail head 38 and outer side 72 of rail head 39. The wheels 18 and 20 also include circumferential flange juncture surfaces 75 and 77 respectively joining and positioned between the cylindrical surface 46 and the inside surface 58 of flange 50 and joining and positioned between the cylindrical surface 48 and the inside surface 60 of flange 52. The circumferential juncture surfaces 75 and 77 respectively include curved portions 86 and 88 which each have a cross-sectional radius of curvature b larger than the radius a of the facing rail shoulder surface, as shown in FIG. 4A. The inside surfaces 58 and 60 of the flanges 50 and 52 also preferably extend in a radially outward direction and axially away from the rails the surfaces face as shown in FIG. 4. The angle of extension of the surfaces 58 and 60 relative to a vertical plane is preferably the same as the angle of the rail head inner sides which the surfaces 58 and 60 face. In addition, the inside surfaces 58 and 60 of the flanges 50 and 52 include curved portions 82 and 84 respectively connected to flange juncture surfaces 75 and 77. The curved portions 82 and 84 each have a radius of curvature c larger than that of the flange juncture surface to which they each connect. The clearance distance d between the inside surfaces 59 of the outside flange 54 and the outer side 70 of the rail head 38 is greater than the clearance distance e between the inside surface 58 of the first inside flange 50 of wheel 18 and the inner side 66 of rail head 38, as can be seen in FIG. 4. The same spacing relationship exists with respect to the flanges of drive wheel 20 and the rail head 39. Desirable clearance distances are, for example, $\frac{3}{4}$ inch for d and $\frac{5}{8}$ inch for e. It should be understood, however, that other clearance distances may be used so long as the clearance distance e between the inside flange of the drive wheel and the rail head is always less than the clearance distance d between the outside flange of the drive wheel and the rail head.

Figure 3:
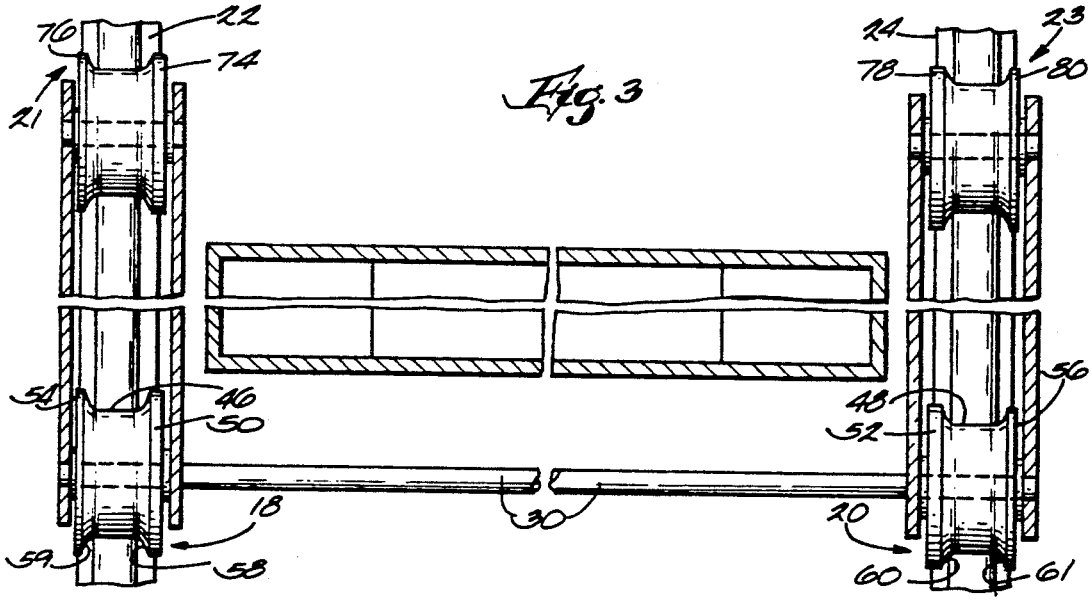
FIG. 3 is a plan view, in cross-section taken along lines 3—3 of FIG. 2 and partially broken away, of the crane illustrated in FIGS. 1 and 2.

The nondriven wheels 21 and 23 are respectively positioned in alignment in the direction of the rails with drive wheels 18 and 20 as shown in FIG. 3. The wheel 21 include radially extending circumferential flanges 74 and 76 which respectively face and are spaced from the inner side 66 and the outer side 70 of the rail head 38. The wheel 23 includes radially extending circumferential flanges 78 and 80 which respectively face and are spaced from the inner side 68 and the outer side 72 of the rail head 39. The clearance space or distance of both flanges of each wheel 21 and 23 is most desirably at least equal to or greater than the clearance distance e between the inside flange surfaces 59 and 61 and their respective facing outer sides 70 and 72 of the rail heads.

Figure 5:
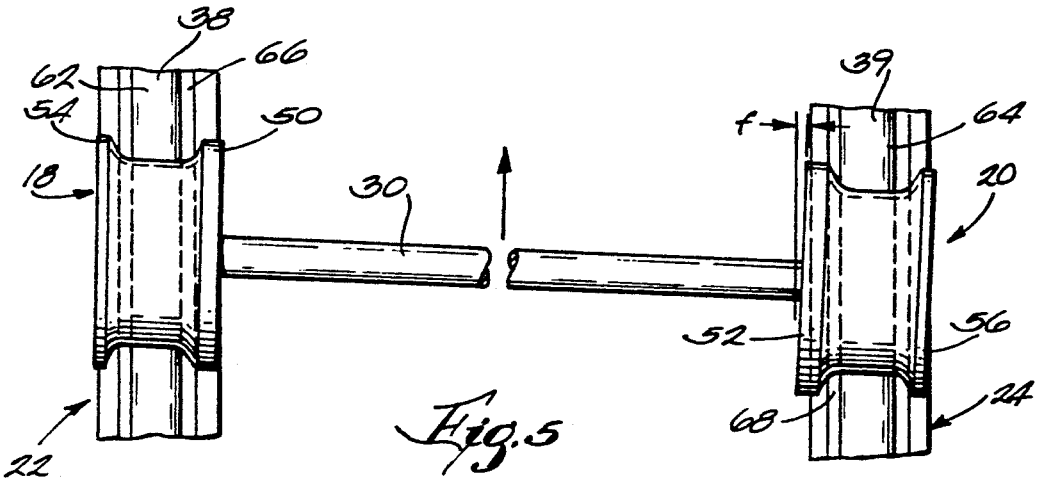
FIG. 5 is a plan view showing only the drive wheels of the crane in a skewed position on the rails with the angle of the skew exaggerated for illustrative purposes.
Figure 6:
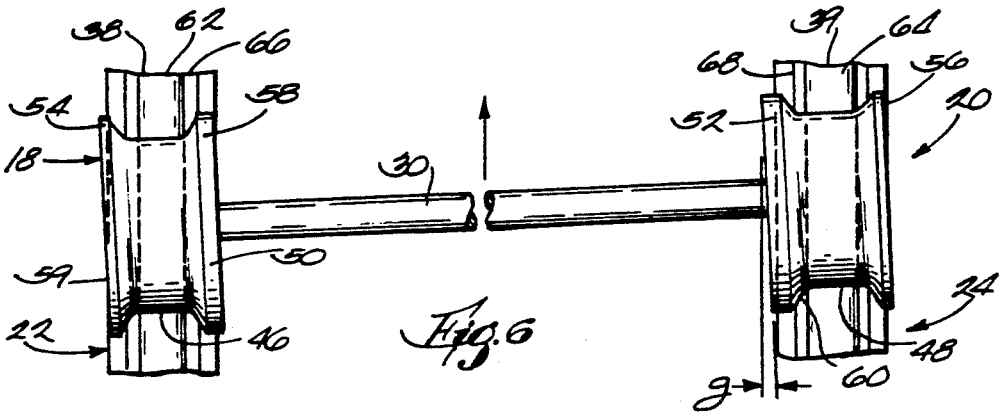
FIG. 6 is a plan view showing only the drive wheels of the crane shown in a skewed position on the rails opposite to the skewed position shown in FIG. 5 with the angle of the skew exaggerated for illustrative purposes.

The crane has a normally parallel position during its travel in which it moves in a direction parallel to the rails 22 and 24 and the wheels 18 and 20 respectively travel on the rails 22 and 24 in the positions shown in FIG. 3. Although the rails 22 and 24 are generally parallel, they may also in many cases be somewhat displaced from their parallel relationship at various places along their length for the reasons previously discussed. Also, traction of the wheels 18 and 20 on the rails 22 and 24 is affected by moisture, particles or other material on the rails or wheels or both. As a consequence of either lack of rail parallelism or traction problems, if the rotation of either wheel 18 or 20 is delayed by contact with a side of one of the rails 22 and 24 or by slippage, the position of the delayed wheel will lag the other wheel which will then become the leading wheel. The wheels, and the entire crane, are then considered to be skewed and the extent and angle of the skew is determined by the amount of skew force on the wheels. In FIGS. 5 and 6, the skew angles are designated skew angles f and g for opposite directions of skew. As stated in the description of the drawings, the angle of skew shown in FIGS. 5 and 6 is exaggerated for illustration purposes herein.

Figure 6A:
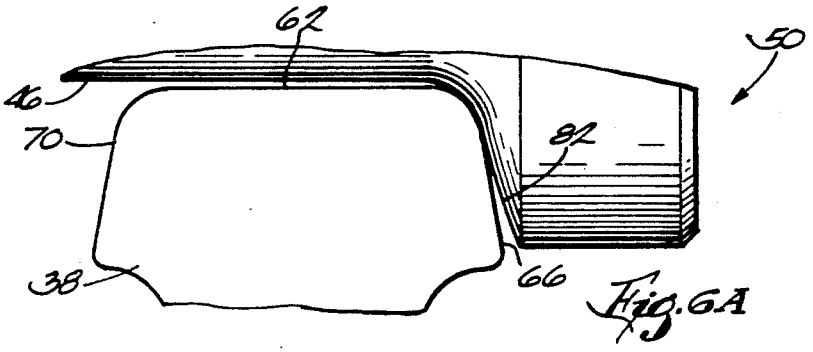
FIG. 6A is an enlarged front elevation view, broken away and illustrating one of the wheels and a rail shown in FIG. 6.

The correction of the skewing is accomplished in accord with the invention in the same way whether the lagging wheel is drive wheel 18 or drive wheel 20. Consequently, only the correction of the skewed condition shown in FIG. 6 in which wheel 18 is the lagging wheel and wheel 20 is the leading wheel will be described in detail. With reference to FIG. 4A, during relatively straight line travel of the crane, only the cylindrical surface 46 of the wheel 18 and the top side 62 of the rail head are in engagement with each other. The skewing forces on the wheel 18 are such that the shoulder surface 71 of the wheel 18 does not engage the flange juncture surface 75 or the curved portion 82 of the flange 50. However, as skew force is increased somewhat, but nevertheless remains relatively small, the wheel 18 will move to a skewed position as shown in FIG. 6A in which the rail head shoulder surface 71 engages only a small part of the flange juncture surface 75. The small level of skew necessary to cause the flange juncture surface 75 to move into engagement with the rail head shoulder surface 71 occurs frequently and permits easy skew correction and steering when skew is not extreme. Such easy skew correction is enabled by the slightly larger cross-section radius of curvature b of the flange juncture surface as compared to the radius of curvature a of the rail head shoulder surface 71. The curvature radius difference of the rail head shoulder surface 71 and the flange juncture surface 75 may be 1/16", i.e., the radius b is preferably 1/16" greater than radius a, although a larger radius differential may be used. With a small difference in the radius of the two surfaces, small levels of skew will often be quickly corrected before the small skew leads to a higher level of skew causing engagement of the flange surface 58 and the rail head side 66 and greater deteriorating forces on the wheel and rail. The flange 50 also has a more radial outward curved portion 82 connected to the flange juncture surface 75 and curving in an opposite direction to the flange juncture surface 75, that is, in a direction axially away from the rail head surface 66. The outward curvature of the curved portion 82 of the flange 50 ensures that the flange does not bump or engage the rail head surface 66 and thereby interfere with the easy skew correction due to the engagement of the rail head shoulder surface 71 and the flange juncture surface 75.

Figure 7:
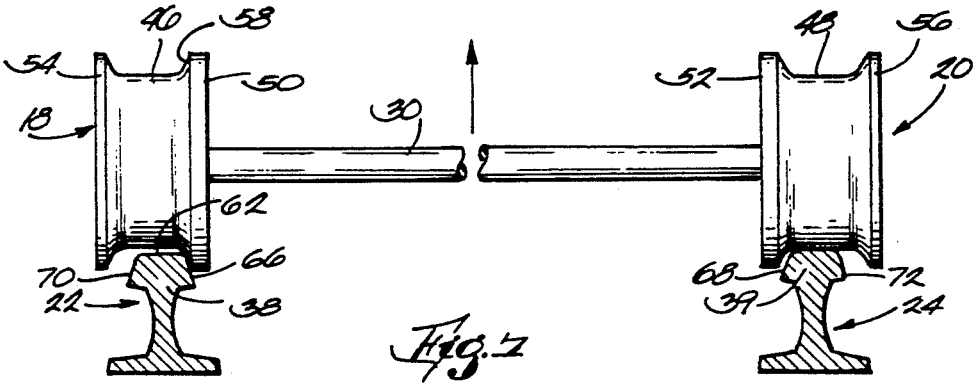
FIG. 7 is a front elevation view of only the drive wheels of the crane of FIGS. 1-3 in a skewed position in which the lagging skewed wheel is in a position causing the correction of the skew.
Figure 7A:
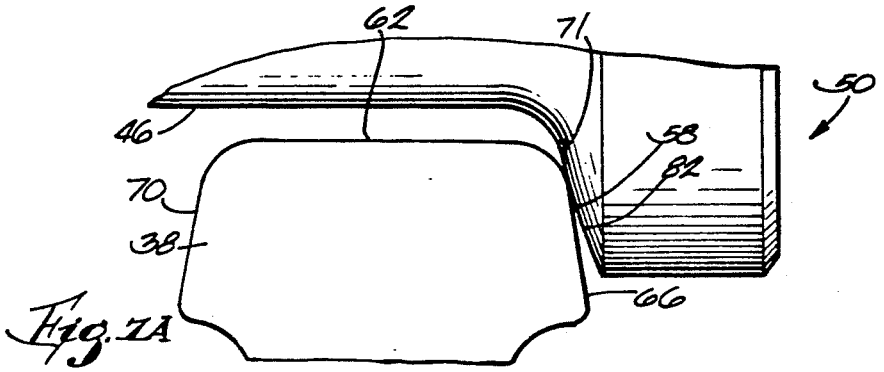
FIG. 7A is an enlarged front elevation view, broken away and illustrating one of the wheels and a rail shown in FIG. 7.

In the event that the skew force is of a higher level than that causing the skew shown in FIGS. 6 and 6A, the curved portion 82 of the inside surface 58 of the inside flange 50 of the drive wheel 18 engages the inner side 66 of the rail head 38. In the travel direction of the crane and wheels shown in FIG. 6, the wheel 18 has a linear path of travel transverse to the rail 22 and toward the rail head 38. As the wheel 18 follows this travel path, the curved portion 82 of the surface 82 rotates into and against the inner side 66 of the rail head 38. This motion of the flange 50 causes it to rotate on to the side surface 66 of the rail head 38 at the larger diameter of the inside surface 58 of the flange 50, as illustrated in FIGS. 7 and 7A, rather than at the smaller diameter of the cylindrical surface 46 as illustrated in FIG. 4. The rotation of the inside surface 58 against the rail side surface 66 at a larger diameter area will, in turn, cause the wheel 18 to travel at a higher linear speed than the linear speed of the wheel 20 which continues to travel along its cylindrical surface 48 on the surface 64 of the head 39 of rail 24. Thus, since the wheels 18 and 20 are interconnected so that they both rotate at the same speed, the higher linear speed of the lagging wheel 18 will cause it to catch up with the leading wheel 20 and correct the skew. The crane thus is returned to its parallel position on the rails 22 an 24.

As previously described, the clearance distances e between the flange inside surface 58 and the rail head surface 66 and between the flange surface 60 and the rail head surface 68 are smaller than the clearance distance d between the flange surface 59 and the rail head surface 70 and between the flange surface 61 and the rail head surface 72. Therefore, the engagement of the flange surfaces 58 and 60 with the rail head surfaces is minimized. Consequently, the exacerbation of the skew and prevention of skew corrective engagement of the flange surfaces 58 and 60 respectively with the rail head surfaces 66 and 68 is also minimized.

The curvature of the curved portion 82 of inside surface 58 also permits the wheel 18 to "ride up" on to the rail head inner side 66 at a lower angle. Thus, less skew force is required to increase the diameter i, shown in FIG. 4, of the engagement of the wheel and rail head and correct the skew.

An apparatus and method has been described in which skewing of an overhead crane traveling on parallel rails and having drive wheels driven at the same rotational speed will quickly and readily correct the skewed condition. Moreover, the skew correction is accomplished without the need for any additional sensing or corrective apparatus beyond the drive wheels and ordinary drive mechanism of the crane.

It will be understood that the foregoing description of the present invention is for purposes of illustration and that the invention is susceptible to a number of modifications or changes none of which entail any departure from the spirit and scope of the present invention as defined in the hereto appended claims.

What is claimed is:

1. In a traveling crane supported on a pair of spaced apart generally parallel rails and including a frame spanning the space between the rails, a truck attached to the frame adjacent each rail, at least one wheel rotatably mounted on each truck in engagement with one of the rails for movement at a linear speed in the direction of the parallel rails whereby the crane travels along and in a position parallel to the rails, the crane also having two oppositely skewed positions while traveling on the rails, and drive means for always rotating a first wheel on one of the trucks and a second wheel on the other of the trucks at the same speed, the combination comprising:

each one of the rails includes a head having a top side, an inner side, an outer side and a rail head shoulder surface joining the top side and the inner side, the rail head shoulder surface including a cross-sectional curvature having a shoulder radius;

each one of the first and second wheels have an axially extending single diameter cylindrical surface engaging the top side of a rail head and a radially extending circumferential flange facing the inner side of a rail head;

in one of the skewed positions of the crane one of the first and second wheels lags the other and is subject to high levels of skew force such that the flange of the lagging wheel and the inner side of the rail head it faces engage each other and to small levels of skew force less than said high levels of skew force; and each one of the first and second wheels includes flange juncture means joining the cylindrical surface and the flange, the flange juncture means facing the shoulder surface of the rail head and including a flange cross-sectional curvature having a flange radius greater than the shoulder radius, for moving into engagement with the shoulder surface in response to said small levels of skew force to increase the diameter of the lagging one of the wheels in engagement with the shoulder surface and increase the linear speed of said lagging one of the wheels to correct skew and minimize the engagement of the flange of the lagging wheel and the inner side of the rail head it faces.

2. The traveling crane according to claim 1 wherein each flange juncture means has a diameter increasing along the curvature defined by the flange radius in a direction away from the cylindrical surface.

3. The traveling crane according to claim 1 wherein each flange has a cross-sectional curved portion having a curvature in a radial outward direction away from the inner side of the rail head for avoiding engagement between the flange and the inner side of the rail head during small skew force correcting engagement between the flange juncture means and the rail head shoulder surface.

4. The traveling crane according to claim 1 wherein each flange includes circumferential contour means extending from the flange juncture means in an axial direction away from the inner side of the rail head the first flange faces for avoiding interference with the engagement of the flange juncture means and the rail head shoulder surface in response to small levels of skew force.

5. In a traveling crane supported on a pair of spaced apart generally parallel rails and including a frame spanning the space between the rails, a truck attached to the frame adjacent each rail, at least one wheel rotatably mounted on each truck in engagement with one of the rails for movement at a linear speed in the direction of the parallel rails whereby the crane travels along and in a position parallel to the rails, the crane also having two oppositely skewed positions while traveling on the rails, and drive means for always rotating a first wheel on one of the trucks and a second wheel on the other of the trucks at the same speed, the combination comprising:

at least one of the rails including a head having a top side, an inner side, an outer side and a rail head shoulder surface joining the top side and the inner side, the rail head shoulder surface including a cross-sectional curvature having a shoulder radius;

the first wheel has an axially extending single diameter cylindrical surface engaging the top side of a rail head, a radially extending circumferential flange surface facing the inner side of a rail head, a circumferential flange juncture surface joining the cylindrical surface and the flange surface and having a larger diameter than that of the cylindrical surface, the flange juncture surface facing the rail head shoulder surface and including a curved portion having a cross-sectional radius of curvature larger than that of the rail head shoulder surface; and in one of the skewed positions of the crane the first wheel lags the second wheel and is subject to skew force during which only the rail head shoulder surface and the flange juncture surface of the first wheel engage each other whereby the larger diameter of the flange juncture surface causes the first wheel to travel at a higher linear speed and correct the skew of the crane.

6. The traveling crane according to claim 5 wherein:

in said one of the skewed positions of the crane it is subject to high levels of skew force such that the inner side of the rail head and the circumferential flange surface engage each other and to small levels of skew force less than said high levels of skew force; and only the rail head shoulder surface and the flange juncture surface engage each other during small levels of skew force whereby small levels of skew are corrected without engagement of the inner side of the rail head and the circumferential flange surface.

7. The traveling crane according to claim 5 wherein the circumferential flange surface has a cross-section curvature including a curved portion connected to the flange juncture surface and curved in a direction away from said inner side of the rail head.

8. The traveling crane according to claim 7 wherein the curved portion of the cross-section curvature of the circumferential flange surface has a radius of curvature larger than that of the curved portion of the flange juncture surface.

9. The traveling crane according to claim 8 wherein the curved portion of the cross-section curvature of the circumferential flange surface is connected to the curved portion of the flange juncture surface at a tangent to the latter substantially parallel to the inner side of the rail head.

10. The traveling crane according to claim 9 wherein said tangent is at an angle of fifteen degrees with the vertical.

11. The traveling crane according to claim 5 wherein said circumferential flange surface has a curvature away from the inner side of the rail head, said curvature beginning a distance radially outward from the cylindrical surface not greater than the cross-sectional radius of the flange juncture surface.

12. In a traveling crane supported on a pair of spaced apart generally parallel rails and including a frame spanning the space between the rails, a truck attached to the frame adjacent each rail, at least one wheel rotatably mounted on each truck in engagement with one of the rails for movement at a linear speed in the direction of the parallel rails whereby the crane travels along and in a position parallel to the rails, the crane also having two oppositely skewed positions while traveling on the rails such that a first wheel on one of the trucks and a second wheel on the other of the trucks respectively have a relative leading and lagging position when the crane is in one of the skewed positions and an opposite leading and lagging position when the crane is in the other of the skewed positions, and drive means for always rotating the first and second wheels at the same speed, the combination comprising:

each one of the rails includes a head having a top side, an inner side, an outer side and a rail head shoulder surface joining the top side and the inner side, the rail head shoulder surface including a cross-sectional curvature having a shoulder radius;

each one of the first and second wheels has an axially extending single diameter cylindrical surface engaging the top side of a rail head and radially extending spaced apart circumferential first and second flange surfaces;

the first and second circumferential flange surfaces of each wheel respectively facing and spaced a distance from the inner side and the outer side of a rail head, the distance between the first flange surface of each of said wheels and the faced inner side of the rail head being less than the distance of the space between the second flange surface of each first and second wheel and the outer side of the rail head which the second flange surface of said wheels each face;

in one of the skewed positions of the crane one of the first and second wheels lags the other and is subject to high levels of skew force and to small levels of skew force less than said high levels of skew force;

each one of the first and second wheels includes flange juncture means joining the cylindrical surface and the flange surface, the flange juncture means facing the shoulder surface of a rail head and including a flange cross-sectional curvature having a flange radius greater than the radius of the faced shoulder surface, for moving into engagement with the faced shoulder surface in response to said small levels of skew force to increase the diameter of the lagging one of the first and second wheels in engagement with the shoulder surface and increase the linear speed of said lagging one of the wheels to correct skew; and the first flange surface of the lagging one of the first and second wheels engaging the faced inner side of a rail head when the crane is in one of the skewed positions in response to said high levels of skew force due to said lesser spacing distance of the first flange surface of the first and second wheels such that the lagging wheel travels toward and onto an inner side of the rail head faced by the first flange surface along a path which is toward and on to the rail head on the first flange along a diameter of the first flange surface larger than the diameter of the cylindrical surface of the leading wheel whereby the linear speed of the lagging wheel increases to a value greater than the linear speed of the leading wheel of the first and second wheels to move the crane toward a parallel position on the rails.

* * * * *